United States Patent [19]

Wall

[11] 4,423,531

[45] Jan. 3, 1984

[54] FLEXIBLE HAIRBRUSH

[75] Inventor: Albert Wall, Lodi, Calif.

[73] Assignee: Pro-Flex, Inc., Stockton, Calif.

[21] Appl. No.: 425,063

[22] Filed: Sep. 27, 1982

[51] Int. Cl.[3] ..... A46B 1/00; A46B 9/02

[52] U.S. Cl. ..... 15/187; 15/160; 15/201; 132/85; 132/126; 132/129; 132/138

[58] Field of Search ..... 15/159 R, 160, 172, 15/186, 187, 188, 201, 203, 159 A; 132/85, 126, 129, 133, 138; D4/31

[56] References Cited

U.S. PATENT DOCUMENTS

| | | | |
|---|---|---|---|
| 2,795,807 | 11/1952 | Salvy | 15/176 |
| 2,963,729 | 12/1960 | Thonbo et al. | 15/176 |
| 3,727,260 | 4/1973 | Spydevold | 15/159 A |
| 3,739,419 | 6/1973 | Natman et al. | 15/187 |
| 4,030,158 | 6/1977 | Blair | 15/159 A |
| 4,057,867 | 11/1977 | Ballin | 15/185 |

FOREIGN PATENT DOCUMENTS 954436 12/1949 France .

*Primary Examiner*—Edward L. Roberts

*Attorney, Agent, or Firm*—Fitch, Even, Tabin & Flannery

[57] ABSTRACT

A hairbrush has a pair of rigid side members and a flexible bristle plate disposed therebetween. A first face of the bristle plate has bristles extendingly outwardly therefrom. The side members include means for selectively manipulating the brush to flex the first face of the bristle plate into a concave or a convex position.

19 Claims, 18 Drawing Figures

FIGURE 15
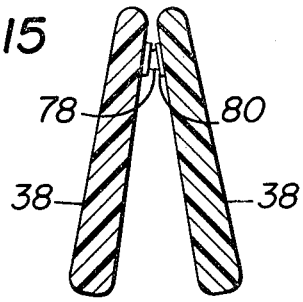
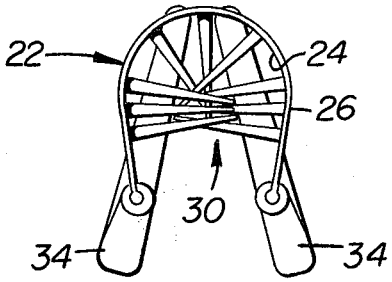
FIGURE 14
FIGURE 10
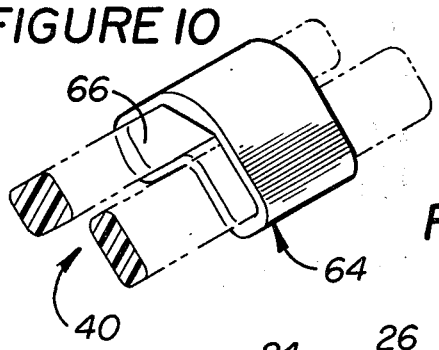
FIGURE 13
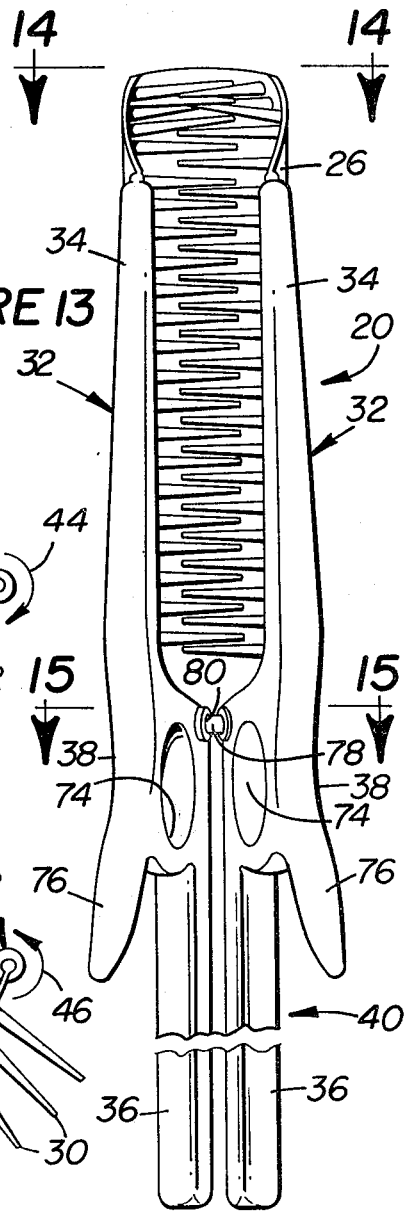
FIGURE 4
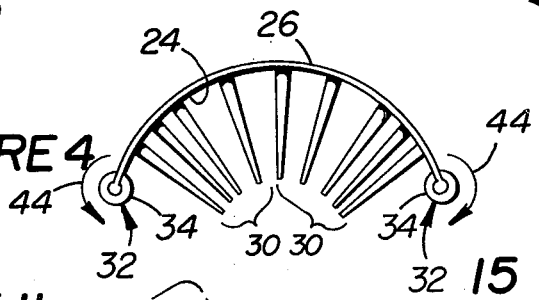
FIGURE 11
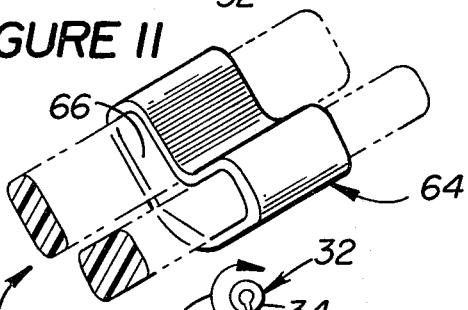
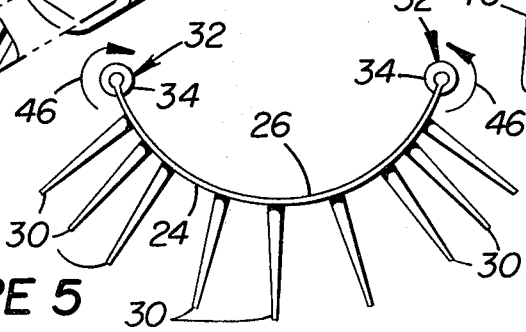
FIGURE 5

FIGURE 8
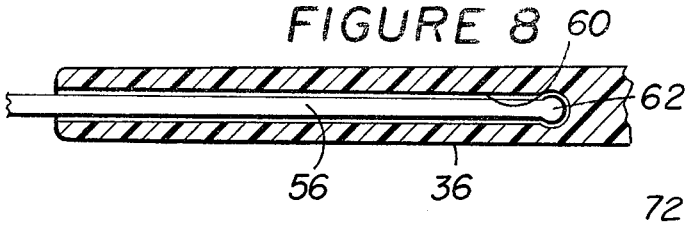
FIGURE 12
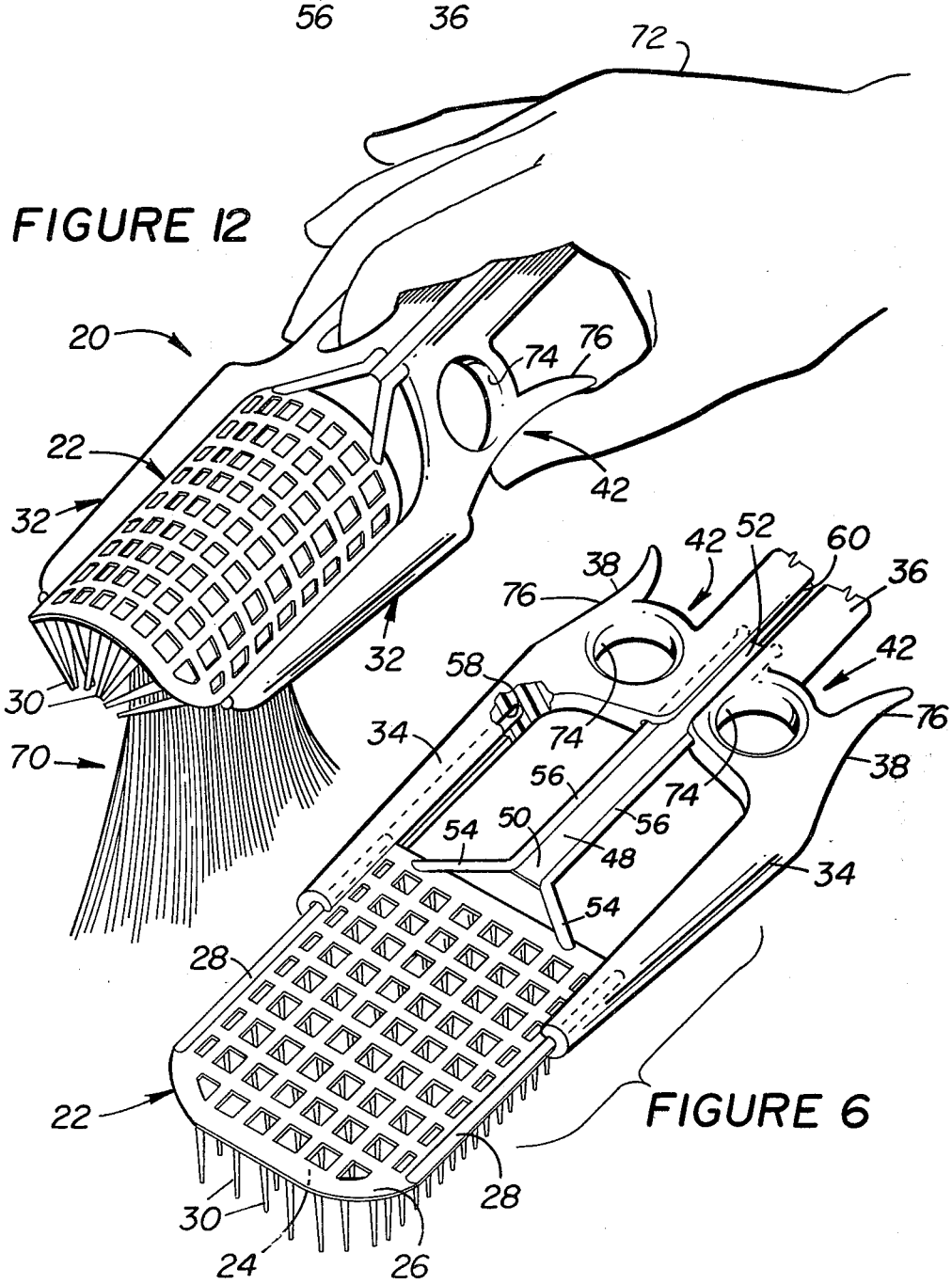
FIGURE 6

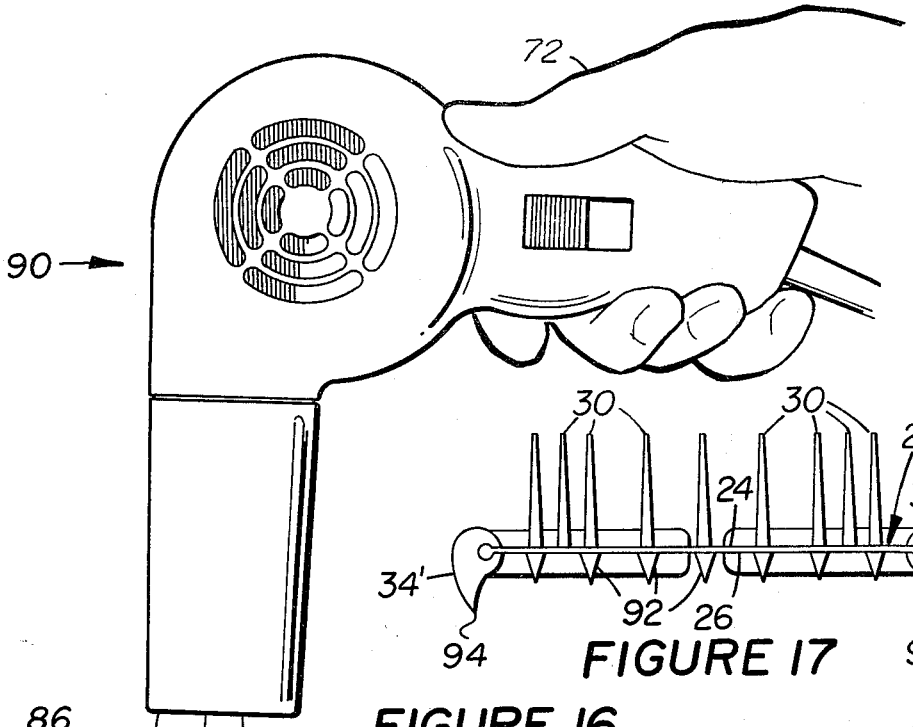
FIGURE 16
FIGURE 17
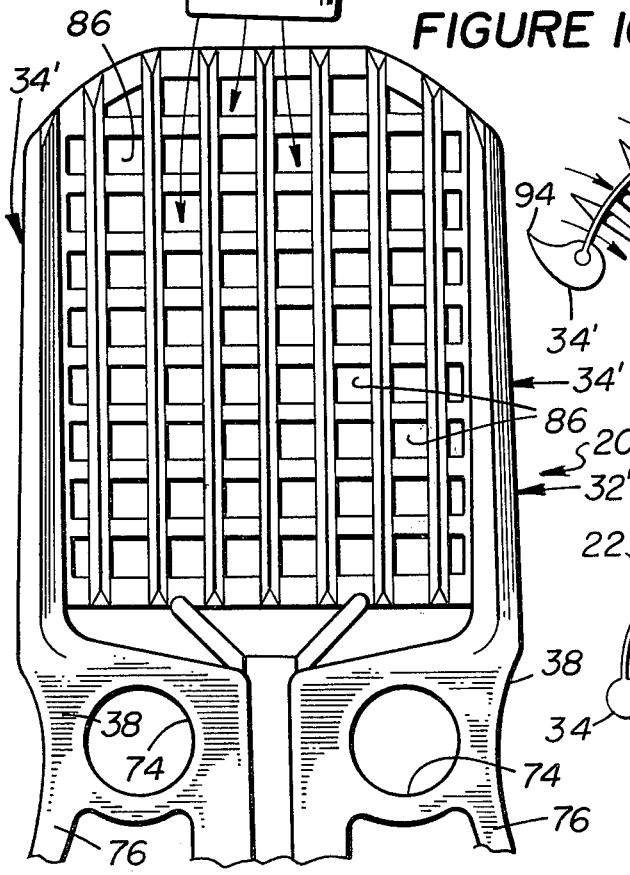
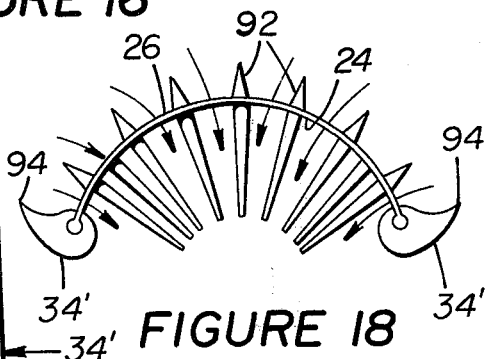
FIGURE 18
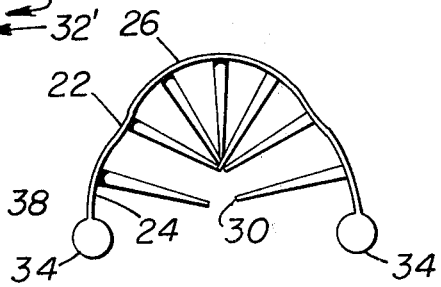
FIGURE 9

FLEXIBLE HAIRBRUSH

The present invention relates generally to brushes and, more particularly, to a flexible hairbrush wherein the bristle plate is selectively manipulated into a concave or convex position.

Many types of hairbrushes are known in the art. Some hairbrushes provide for a removable brush part from the handle. For example, in U.S. Pat. No. 2,963,729, Thonbo et al, issued Dec. 13, 1960, an elastomeric brush part is received by a handle in slidible engagement, with positive locking occuring by tension within the elastomeric brush part locking edge flanges into the handle. Another type of elastomeric brush is constructed so that the brush may be folded and carried in the pocket as disclosed in U.S. Pat. No. 4,057,867, Ballin, issued Nov. 15, 1977.

It is also desirable to provide brushes with openings through the bristle plates so that hot air, such as from a hand held blow dryer, may escape through the brush to facilitate styling and blow waving. Such a brush has been disclosed in U.S. Pat. No. 4,030,158, Blair et al, issued June 21, 1977.

However, the disadvantage and limitation of the above disclosed brushes is that the body of the brushes is of generally rigid construction and the brush and bristle pattern may not be changed. When styling hair, it then becomes necessary to use different types of brushes to achieve various styling effects. Such different types of brushes may include circular curling brushes, flat brushes and curved brushes.

It is therefore an important object of the present invention to overcome one or more disadvantages and limitations hereinabove enumerated.

It is yet another object of the present invention to provide a flexible hairbrush wherein the bristle plate is selectively manipulated into a concave or convex position.

It is yet another object of the present invention to provide such a flexible hairbrush which has openings therethrough to facilitate the flow of hot air therethrough for blow waving and styling.

Other advantages, objects and features of the present invention will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

FIG. 4 illustrates the bristle plate of the hairbrush of FIG. 1 in a concave position;

FIG. 5 illustrates a bristle plate of the hairbrush of FIG. 1 in a convex position;

FIG. 6 illustrates a modification to the hairbrush of FIG. 1 with a removable bristle plate element;

FIG. 8 illustrates a fabrication step of the embodiment of the hairbrush shown in FIG. 7;

FIG. 9 is a view similar to FIG. 4 showing the bristle plate in a concave position for the embodiment of the hairbrush illustrated in FIG. 7;

FIG. 10 illustrates a locking device received by the handle of the hairbrush of FIG. 1 to maintain the bristle plate in the position shown in FIG. 4;

FIG. 11 illustrates the locking device of FIG. 10 in an alternate position to maintain the bristle plate in the position as shown in FIG. 5;

FIG. 12 illustrates one particularly useful application of the flexible hairbrush according to the principles of the present invention.

FIG. 13 illustrates the hairbrush of FIG. 1 in a folded position;

FIG. 14 is an edge view of the folded brush taken along line 14–14 of FIG. 13;

FIG. 15 is a cross-sectional view of the folded brush taken along line 15–15 of FIG. 13;

FIG. 16 is a bottom view of yet another embodiment of a flexible hairbrush according to the principles of the present invention;

FIG. 17 is a view similar to FIG. 2 of the embodiment of the hairbrush shown in FIG. 16;

Figure 1:
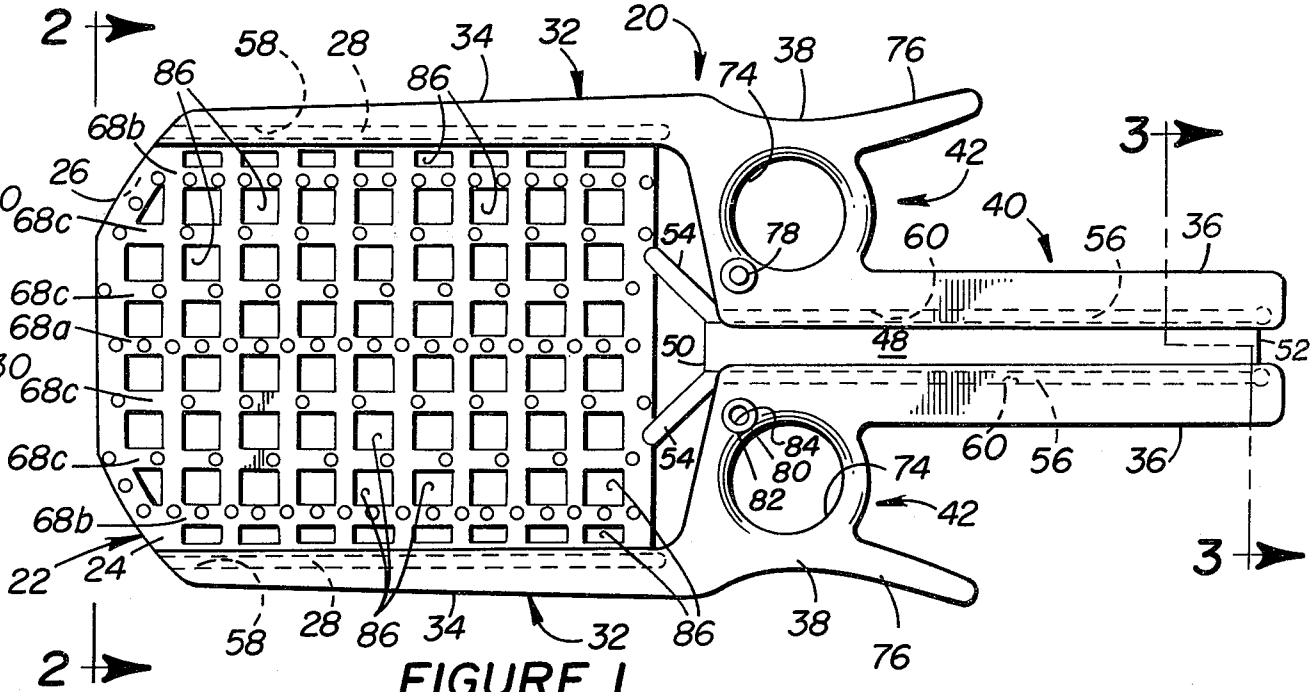
FIG. 1 is a plan view of one embodiment of a flexible hairbrush according to the principles of the present invention.

FIG. 18 is a view similar to FIG. 4 illustrating the embodiment of the hairbrush as shown in FIG. 15; and Broadly stated, a hairbrush according to the principles of the present invention includes a generally planar bristle plate having a plurality of bristles extending outwardly from a face thereof, and a pair of members in a facing relationship with each other and engageable with longitudinal edges of the bristle plate, such members having means for selectively manipulating the members in a first direction and in a second direction. When the members are manipulated in the first direction the bristle plate becomes concave and, when manipulated in the second direction the bristle plate becomes convex.

Referring now to FIGS. 1–5, there is shown a first embodiment of a hairbrush 20 including a generally planar bristle plate 22 having a first face 24, a second face 26, a pair of longitudinal edges 28 and a plurality of bristles 30 extending outwardly from first face 24. Hairbrush 20 further includes a pair of members 32 in a facing relationship with each other, each of members 32 having a first portion 34 a second portion 36 and a third portion 38 interconnecting first portion 34 and second portion 36. First portion 34 of each of members 32 is engageable with a different one of each of longitudinal edges 28. Second portion 36 of each of members 32 is spaced from each other defining a handle 40 dimensioned to be received in a palm of a hand. Third portion 38 of each of members 32 has means 42 for selectively manipulating members 32 in a first direction illustrated by arrow 44 and in a second direction illustrated by arrow 46. As best seen in FIG. 4, first face 24 is concave when members 32 are manipulated in the first direction shown by arrow 44. As best seen in FIG. 5, first face 34 is convex when members 32 are manipulated in the second direction shown by arrow 46.

Hairbrush 20 further includes a generally elongated planar member 48 having a first end portion 50 and a second end portion 52, and a pair of guides 54 extending outwardly from first end portion 50. Planar member 48 is in engagement with second portion 36 of each of members 32. Guides 54 are in engagement with bristle plate 22.

Figure 3:
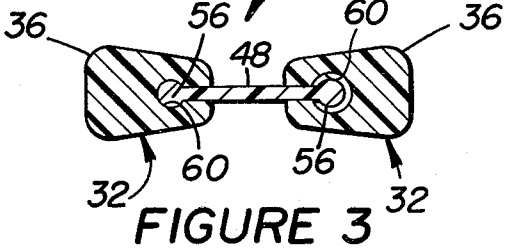
FIG. 3 is a cross-sectional view of a portion of the hairbrush taken along line 3—3 of FIG. 1.

In one embodiment of the present invention, all of bristle plate 22, planar member 48 and guides 54 are of unitary construction. Planar member 48 further has a pair of longitudinal edges 56, each engageable with second portion 36 of a different one of members 32. As best seen in FIGS. 1 and 3, each of members 32 has a first longitudinal channel 58 disposed in first portion 34 and a second longitudinal channel 60 disposed in second portion 36. Each of longitudinal edges 28 are in rotational engagement in a different one of longitudinal channels 58 of first portion 34, each of longitudinal edges 56 are in rotational engagement in a different one of longitudinal channels 60 of second portion 36. Such rotational engagement prevents warping of the bristle plate when each of members 32 is manipulated so that brush 20 assumes the positions shown in FIGS. 4 and 5.

Referring now also to FIG. 6, when all of bristle plate 22, planar member 48 and guides 54 are of unitary construction as hereinabove described, longitudinal edges 28 of bristle plate 22 and longitudinal edges 56 of planar member 48 may be further in linear slideable engagement with different ones of longitudinal channels 58 of first portion 34 and longitudinal channels 60 of second portion 36, respectively. Such linear slideable engagement allows the bristle plate to be removed for any purpose such as cleaning or replacing with a bristle plate of different design.

Figure 7:
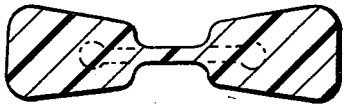
FIG. 7 is a view similar to FIG. 3 but showing an alternate embodiment of the hairbrush of FIG. 1.

Referring now to FIGS. 7, 8 and 9, there are illustrated modifications to brush 20 of FIG. 1 wherein brush 20 is of unitary construction. Bristle plate 22, planar member 48 and guides 54 may be constructed as hereinabove described. Members 32 may then be injected molded about longitudinal edges 28 and 56, FIG. 7 showing a cross-sectional view similar to FIG. 3 of brush 20 of unitary construction. As best shown in FIG. 8, longitudinal edges 28 and 56 may include a spherical end portion 62, only one such longitudinal edge being shown for clarity. The corresponding one of longitudinal channels 58 and 60 may be dimensioned to received spheres 62. During the injection molding process of members 32, the usual material shrinkage upon curing encapsulates sphere 62 to rigidly hold bristle plate 22 and planar member 48 in locking engagement with members 32. FIG. 9 illustrates that when brush 20 is of unitary construction, longitudinal edges 28 and 48 are not in rotatable engagement within the respective one of channels 58 and 60, bristle plate 22 will show a configuration, exemplified in FIG. 9, when brush 20 is manipulated into the first position.

Referring now to FIGS. 10 and 11 brush 20 may further include a generally V-shaped locking device 64 having an opening 66 dimensioned to receive handle 40. Locking device 64 receives handle 40 so that brush 20 is selectively engaged into the position shown in FIGS. 4 and 5.

Referring once again to FIGS. 1 and 2, bristles 30 are arranged to define a plurality of rows 68 generally parallel to longitudinal edges 28. Bristles 30 are arranged in rows 68 to interleave when first face 24 is in an extreme concave position. As best seen in FIG. 1, the teeth in a middle row 68*a* of rows 68 and the teeth in the outer rows 68*b* of rows 68 contain twice as many bristles as those in the intermediate rows 68*c* of row 68. Furthermore, the bristles in adjacent ones of rows 68*c* are laterally staggered to facilitate interleaving.

Referring now also to FIG. 12, the arrangement of bristles 30 within rows 68*a–c* as hereinabove described engages the hair shown at 70 and allows such hair to be pulled away from the scalp to facilitate drying and/or styling. Furthermore such hair may be twisted and curled while being held by brush 20 in such position as shown. Additionally, waving is accomplished by placing the brush 20 so that bristles 30 generally conform to the cirvature of a scalp, rotating brush 20 about its normal axis and blow drying the hair as hereinafter described.

FIG. 12 further illustrates a hand 72 engaged with manipulating means 42. Manipulating means 42 includes a cylindrical opening 74 dimensioned to receive a forefinger of hand 72 and an arcuate member 76 for engagement with a thumb and middle fingers of hand 72. Middle portion 38 of each member 32 includes manipulating means 42 so that brush 20 is usable by right and left handed persons. Gentle pressure of middle fingers and thumb of hand 72 provide the force to move bristle plate into the concave or convex position, the position being selected by the forefinger disposed within cylindrical opening 74.

Referring now to FIGS. 13–15, the interleaving of bristles 30 is more clearly illustrated. With further reference to FIG. 1, third portion 38 of one of members 32 includes a guide pin 78 and third portion of another of members 32 includes a receptacle 80 for receiving guide pin 78. Each of guide pin 78 and receptable 80 when engaged with each other maintain alignment of each of members 32 to each other as best illustrated in FIGS. 13 and 15. Such alignment aids in maintaining the interleaved pattern between bristles 30 to prevent bunching thereof.

Receptacle 80 has a cylinder 82 having a bore 84, cylinder 82 being axially extended upwardly from the other of members 32 as hereinabove described. Bore 74 is dimensioned to receive guide pin 78. Cylinder 82 has an upper end contactable with the first one of members 32 when first face 24 of brush 22 is in an extreme concave position. Cylinder 82 being axially extended bases the tips of bristles 30 from contacting and bunching against first face 24 when in such extreme concave position as best seen in FIG. 14.

As best seen in FIGS. 1, 2, 6 and 12, bristle plate 22 may further have a plurality of openings 86 therethrough and disposed between rows 68, and a plurality of arcuate ribs 88 disposed on second face 26 and underneath a different one of each of rows 68. Openings 86 allow hot air from a hand held dryer be directed through bristle plate 22 to style hair grabbed by bristles 30, such as shown in FIG. 12. Arcuate ribs 88 stiffen bristle plate 22 in the lateral direction while allowing easy flexibility in the longitudinal direction to eliminate warping of bristle plate 22 when manipulated into the concave or convex positions as shown in FIGS. 4 and 5.

Figure 2:
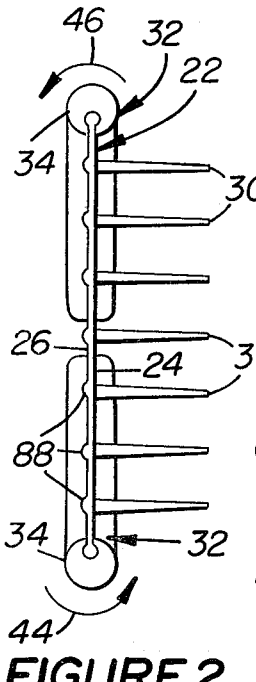
FIG. 2 is an edge view of the hairbrush taken along line 2—2 of FIG. 1.

Referring now to FIGS. 16–18, there is shown a modified embodiment of a brush 20′ in accordance with the principles of the present invention. FIG. 17 is a view similar to FIG. 2 and FIG. 18 is a view similar to FIG. 4, each of FIGS. 17 and 18 showing the modified elements of brush 20′ of FIG. 16. Brush 20′ maximizes the air flow from a hand held dryer 90 through openings 86 of bristle plate 22′.

Bristle plate 22′ has a plurality of web shaped ribs 92, each of ribs 92 being disposed underneath a different one of rows 68. Ribs 92 are arranged to further deflect forced air through openings 86 as shown by a plurality of arrows illustrating the air flow in FIGS. 16 and 18.

Brush 20′, and more particularly first portion 34′ of each of members 32′ may further include a longitudinal fin 94 extending downwardly therefrom, fin 94 being arranged to deflect forced air towards openings 86.

There has been described a novel hairbrush with respect to particular embodiments thereof. It is apparent from the above description and drawings that one skilled in the art may make numerous uses of and modifications to the above described embodiments without departing from the inventive concepts which are defined solely by the spirit and scope of the appended claims.

What is claimed is:

1. A hairbrush comprising:

a generally planar bristle plate having a first face, a pair of first longitudinal edges and a plurality of bristles extending outwardly from said first face;

a pair of members in a facing relationship with respect to each other, each of said members including a first portion, a second portion and a third portion interposed said first portion and said second portion, said first portion of each of said members being engageable with a different one of each of said lateral edges, said second portion of each of said members together defining a handle dimensioned to be received in a palm of a hand, said third portion of each of said members having means for selectively manipulating said members in a first direction and in a second direction, said first face being concave when said members are manipulated in said first direction and convex when said members are manipulated in said second direction.

2. A hairbrush in accordance with claim 1 which further includes:

a generally elongated planar member having a first end portion, a second end portion and a pair of second longitudinal edges, each of said second edges being in engagement with said second portion of a different one of said members; and a pair of guides extending outwardly from said first end portion and being in engagement with said bristle plate.

3. A hairbrush in accordance with claim 2 wherein each of said pair of members has a first longitudinal channel disposed in said first portion thereof and a second longitudinal channel disposed in said second portion thereof, and all of said bristle plate, said planar member and said guides are of unitary construction, said first longitudinal edges and said second longitudinal edges being dimensional to be received in said first channel and said second channel of a different one of said members, respectively.

4. A hairbrush in accordance with claim 3 wherein said first longitudinal edges and said second longitudinal edges are in rotatable engagement with said first channel and said second channel with a different one of said members, respectively.

5. A hairbrush in accordance with claim 3 wherein said first longitudinal edges and said second longitudinal edges are in linear slideable engagement in said first channel and said second channel of each of said pair of members, respectively, and removable therefrom.

6. A hairbrush in accordance with claim 2 wherein said brush is of unitary construction.

7. A hairbrush in accordance with claim 6 wherein selected ones of said first and said second longitudinal edges have a spherical end portion, said pair of members being adapted for lockingly receiving said spherical end portion of said selected ones of said edges.

8. A hairbrush in accordance with claim 1 which further includes:

a locking device received by said handle for selectively locking said handle in said first position or said second position.

9. A hairbrush in accordance with claim 1 wherein said bristles define a plurality of rows generally parallel to said longitudinal edges.

10. A hairbrush in accordance with claim 9 wherein said bristles are arranged in said rows to interleave when said first face if concave.

11. A hairbrush in accordance with claim 10 wherein said bristles in a middle row have twice as many teeth as bristles in other rows.

12. A hairbrush in accordance with claim 11 wherein said bristles in each outer row have twice as many bristles as in intermediate rows.

13. A hairbrush in accordance with claim 12 wherein said bristles in said intermediate rows are laterally staggered from each other, said bristles being arranged to positively grab hair upon said bristles interleaving when said brush is in said concave position.

14. A hairbrush in accordance with claim 10 wherein said third portion of one of said pair of members includes a guide pin and said third portion of an other of said members includes a receptacle for receiving said guide pin, each of said guide pin and said receptacle when engaged with, each other maintaining alignment of each of said pair of members to each other.

15. A hairbrush in accordance with claim 14 wherein said receptacle includes a cylinder having a bore and being axially extended upwardly from said other of said pair of members, said bore being dimensioned to receive said guide pin, said cylinder having an upper end contactable with said one of said pair of members when said first faces in an extreme concave position to space said bristles at their ends from said first face.

16. A hairbrush in accordance with claim 9 wherein said bristle plate further has a plurality of openings therethrough, said openings being disposed between said rows.

17. A hairbrush in accordance with claim 16 wherein said bristle plate further has a second face and a plurality of arcuate ribs disposed on said second face, each of said ribs being disposed underneath a different one of said rows.

18. A hairbrush in accordance with claim 9 wherein said bristle plate further has a second face and a plurality of wedged shaped ribs disposed on said second face, each of said ribs being disposed underneath a different one of said rows, said ribs being arranged to deflect forced air through said openings.

19. A hairbrush in accordance with claim 9 wherein said first portion of each of said pair of members has a longitudinal fin extending downwardly therefrom, said fin being arranged to deflect forced air toward said openings.

* * * * *